US007266850B1

(12) United States Patent
Strum et al.

(10) Patent No.: US 7,266,850 B1
(45) Date of Patent: Sep. 11, 2007

(54) SIDE ARMOR PROTECTION

(75) Inventors: David B. Strum, Amissville, VA (US); Jason Robert Beck, Peoria, AZ (US)

(73) Assignee: Diamondback Tactical, LLP, Peoria, AZ (US)

( * ) Notice: Subject to any disclaimer, the term of this patent is extended or adjusted under 35 U.S.C. 154(b) by 108 days.

(21) Appl. No.: 10/997,570

(22) Filed: Nov. 24, 2004

Related U.S. Application Data

(60) Provisional application No. 60/525,657, filed on Nov. 28, 2003.

(51) Int. Cl.
*F41H 1/02* (2006.01)

(52) U.S. Cl. ..... 2/2.5

(58) Field of Classification Search ..... 2/2.5, 2/463, 461–468, 102, 455, 459
See application file for complete search history.

(56) References Cited

U.S. PATENT DOCUMENTS

| | | | |
|---|---|---|---|
| 264,195 | A | 9/1882 | Quinn, Jr. |
| 562,608 | A | 6/1896 | Herberlin |
| 642,244 | A | 1/1900 | Oldham |
| 761,113 | A | 5/1904 | Van Wagoner et al. |
| 842,498 | A | 1/1907 | Schmidt |
| 921,352 | A | 5/1909 | Blakers et al. |
| 1,044,494 | A | 11/1912 | Clarke |
| 1,210,407 | A | 1/1917 | Boucher |
| 1,246,274 | A | 11/1917 | Jelalian |
| 1,256,422 | A | 2/1918 | Anderson |
| 1,269,019 | A | 6/1918 | Szmyt |
| 1,310,125 | A | 7/1919 | Lundberg et al. |
| 1,348,204 | A | 8/1920 | Brewster |
| 1,350,062 | A | 8/1920 | Brewster |
| 1,655,895 | A | 1/1928 | Davis |
| 1,758,296 | A | 5/1930 | Schaumann |
| 1,764,483 | A | 6/1930 | Watkins |
| 1,772,922 | A | 8/1930 | Volz |
| 1,968,767 | A | 7/1934 | Howard |
| 2,099,431 | A | 11/1937 | Reeb |
| 2,266,886 | A | 12/1941 | McCoy |
| 2,343,142 | A | 2/1944 | Freedman |
| 2,448,416 | A | 8/1948 | Carter |
| 2,557,445 | A | 6/1951 | Lewallen |
| 2,755,566 | A | 7/1956 | Harrison |
| 3,331,083 | A | 7/1967 | Holly |
| 3,529,307 | A | 9/1970 | Nelson et al. |

(Continued)

FOREIGN PATENT DOCUMENTS

| | | |
|---|---|---|
| DE | 4214543 | 11/1993 |

(Continued)

*Primary Examiner*—Danny Worrell
(74) *Attorney, Agent, or Firm*—Brownstein Hyatt Farber Schreck, P.C.

(57) ABSTRACT

According to one embodiment of the invention, a modular apparatus for carrying armor is provided by utilizing an armor carrier configured for receiving various types of armor, such as an armor plate or soft body armor; a coupling device coupled with the armor carrier and configured for coupling the armor carrier with an article of clothing; wherein the armor carrier is configured as a modular unit so as to permit removal and recoupling of the armor carrier with the article of clothing in multiple positions as desired by the user.

20 Claims, 5 Drawing Sheets

U.S. PATENT DOCUMENTS

| | | | | |
|---|---|---|---|---|
| 3,577,836 | A | 5/1971 | Tamura | |
| 3,743,147 | A | 7/1973 | Wilczynski | |
| 3,840,901 | A | 10/1974 | Eyster | |
| 3,957,183 | A | 5/1976 | Gadberry | |
| 4,106,121 | A | 8/1978 | Benson | |
| 4,180,261 | A | 12/1979 | Kolka | |
| 4,194,656 | A | 3/1980 | Zufich | |
| 4,266,300 | A | 5/1981 | Partridge | |
| 4,287,607 | A | 9/1981 | Leach | |
| 4,307,826 | A | 12/1981 | Stewart | |
| 4,318,502 | A | 3/1982 | Lowe et al. | |
| 4,497,069 | A | 2/1985 | Braunhut | |
| 4,507,882 | A | 4/1985 | Harrell | |
| 4,584,228 | A | 4/1986 | Droste | |
| 4,605,335 | A | 8/1986 | Otrusina | |
| 4,645,465 | A | 2/1987 | Courtney | |
| 4,651,355 | A | 3/1987 | White | |
| 4,923,105 | A | 5/1990 | Snyder | |
| 4,973,277 | A | 11/1990 | Khanamirian | |
| 4,999,850 | A | 3/1991 | Grilliot et al. | |
| 5,014,359 | A | 5/1991 | Hanson | |
| 5,016,794 | A | 5/1991 | Beagle, Jr. | |
| 5,023,953 | A | 6/1991 | Bettcher | |
| 5,025,965 | A | 6/1991 | Smith | |
| 5,052,647 | A | 10/1991 | Axelson et al. | |
| 5,054,127 | A | 10/1991 | Zevchak | |
| 5,060,314 | A | 10/1991 | Lewis | |
| 5,063,127 | A | 11/1991 | Oka et al. | |
| 5,063,614 | A | 11/1991 | McSheffery | |
| 5,072,453 | A | 12/1991 | Widder | |
| 5,090,053 | A | 2/1992 | Hayes | |
| 5,184,763 | A | 2/1993 | Blaisdell et al. | |
| 5,201,448 | A | 4/1993 | Schue | |
| 5,215,379 | A | 6/1993 | Pickard et al. | |
| 5,247,707 | A | 9/1993 | Parker et al. | |
| 5,259,093 | A | 11/1993 | D'Annunzio | |
| 5,327,811 | A | 7/1994 | Price et al. | |
| 5,349,893 | A | 9/1994 | Dunn | |
| 5,421,032 | A | 6/1995 | Murphy | |
| 5,465,425 | A | 11/1995 | Crispin | |
| 5,471,906 | A | 12/1995 | Bachner, Jr. et al. | |
| 5,512,348 | A | 4/1996 | Mazelsky | |
| 5,534,343 | A | 7/1996 | Landi et al. | |
| 5,589,254 | A | 12/1996 | Dischler | |
| 5,604,958 | A | 2/1997 | Anscher | |
| 5,609,278 | A | 3/1997 | Fresco | |
| 5,617,984 | A | 4/1997 | Fabel | |
| 5,626,270 | A | 5/1997 | Tseng | |
| 5,628,064 | A | 5/1997 | Chung | |
| 5,639,005 | A | 6/1997 | Chouinard | |
| 5,724,707 | A | 3/1998 | Kirk et al. | |
| 5,754,982 | A | 5/1998 | Gainer | |
| 5,765,738 | A | 6/1998 | Hoffner | |
| 5,806,741 | A | 9/1998 | Kirk | |
| 5,875,944 | A | 3/1999 | Beletsky | |
| 5,903,920 | A | 5/1999 | Granqvist | |
| 5,918,309 | A | 7/1999 | Bachner, Jr. | |
| 5,987,650 | A | 11/1999 | Carroll | |
| 5,991,925 | A | 11/1999 | Wu | |
| 6,012,162 | A | 1/2000 | Bullat | |
| 6,103,641 | A | 8/2000 | Gehring, Jr. | |
| 6,138,277 | A | 10/2000 | Gillen et al. | |
| 6,161,222 | A | 12/2000 | Strickland | |
| 6,161,741 | A | 12/2000 | French | |
| 6,164,048 | A | 12/2000 | Rhodes | |
| 6,175,958 | B1 * | 1/2001 | Wu | 2/2.5 |
| 6,185,738 | B1 * | 2/2001 | Sidebottom | 2/2.5 |
| 6,209,145 | B1 * | 4/2001 | Tillett | 2/464 |
| 6,233,737 | B1 | 5/2001 | Ditchfield | |
| 6,233,740 | B1 | 5/2001 | Meyers et al. | |
| 6,264,079 | B1 | 7/2001 | Skaggs | |
| 6,266,818 | B1 | 7/2001 | Howland et al. | |
| 6,279,804 | B1 | 8/2001 | Gregg | |
| 6,319,862 | B1 | 11/2001 | Czetto, Jr. | |
| D455,548 | S | 4/2002 | Cragg | |
| 6,431,420 | B1 | 8/2002 | Cragg | |
| 6,449,769 | B1 | 9/2002 | Bachner, Jr. | |
| 6,453,791 | B1 | 9/2002 | Seitzinger | |
| 6,516,981 | B2 | 2/2003 | Perez et al. | |
| 6,519,775 | B1 | 2/2003 | Garcia | |
| 6,543,055 | B2 | 4/2003 | Howland et al. | |
| 6,547,118 | B2 | 4/2003 | Beletsky et al. | |
| 6,588,640 | B1 | 7/2003 | Rogers et al. | |
| 6,627,562 | B1 | 9/2003 | Gehring, Jr. | |
| 6,634,531 | B2 | 10/2003 | Conte | |
| 6,685,066 | B2 | 2/2004 | Cragg | |
| 6,691,906 | B2 | 2/2004 | Cragg | |
| 6,698,024 | B2 | 3/2004 | Graves et al. | |
| 6,703,104 | B1 | 3/2004 | Neal | |
| 6,704,934 | B2 | 3/2004 | Graham et al. | |
| 6,738,984 | B2 | 5/2004 | Gillen et al. | |
| D496,143 | S | 9/2004 | Noell et al. | |
| D500,807 | S | 1/2005 | Noell et al. | |
| D501,592 | S | 2/2005 | Noell et al. | |
| D501,989 | S | 2/2005 | Cook et al. | |
| D501,991 | S | 2/2005 | Cook et al. | |
| 6,851,160 | B2 | 2/2005 | Carver | |
| D503,039 | S | 3/2005 | Cook et al. | |
| D505,773 | S | 6/2005 | Noell et al. | |
| D505,774 | S | 6/2005 | Noell et al. | |
| 6,907,617 | B2 | 6/2005 | Johnson | |
| 2002/0120973 | A1 | 9/2002 | D'Annunzio | |
| 2003/0104738 | A1 | 6/2003 | Porter | |
| 2003/0141328 | A1 | 7/2003 | Cragg | |
| 2004/0016784 | A1 | 1/2004 | Berry | |
| 2004/0035900 | A1 | 2/2004 | Cragg | |
| 2004/0045428 | A1 | 3/2004 | Citerrio | |
| 2004/0112932 | A1 | 6/2004 | Cragg | |
| 2004/0132368 | A1 | 7/2004 | Price et al. | |
| 2004/0221361 | A1 | 11/2004 | D'Annunzio | |
| 2004/0226971 | A1 | 11/2004 | Cook | |
| 2004/0238571 | A1 | 12/2004 | Noell et al. | |
| 2005/0005342 | A1 | 1/2005 | Johnson | |
| 2005/0005343 | A1 | 1/2005 | Johnson | |

FOREIGN PATENT DOCUMENTS

| | | |
|---|---|---|
| EP | 0226265 | 6/1987 |
| FR | 2391446 | 5/1978 |
| FR | 2699265 | 12/1992 |
| GB | 425066 | 3/1935 |
| JP | 3019650 | 11/1995 |
| JP | 136190 | 5/1996 |
| JP | 2000008208 | 1/2000 |
| JP | 2000193396 | 7/2000 |
| JP | 2000282307 | 10/2000 |
| JP | 2001235299 | 8/2001 |
| JP | 2002173383 | 11/2003 |
| JP | 2003329396 | 11/2003 |
| WO | WO92/08094 | 5/1992 |
| WO | WO92/13250 | 8/1992 |
| WO | WO 00/28273 | 5/2000 |

* cited by examiner

SIDE ARMOR PROTECTION

CROSS-REFERENCES TO RELATED APPLICATIONS

This application claims the benefit of U.S. Patent Application 60/525,657 entitled "Side Armor Protection" filed on Nov. 28, 2003, the content of which is hereby incorporated by reference in its entirety for all purposes.

STATEMENT AS TO RIGHTS TO INVENTIONS MADE UNDER FEDERALLY SPONSORED RESEARCH OR DEVELOPMENT

Not Applicable

REFERENCE TO A "SEQUENCE LISTING," A TABLE, OR A COMPUTER PROGRAM LISTING APPENDIX SUBMITTED ON A COMPACT DISK

Not Applicable

One embodiment of the invention relates generally to a side armor protection device. For example, one particular embodiment of the invention relates to modular body armor for protecting the lateral torso region of a user.

BACKGROUND

Body armor has traditionally been provided for the chest and back areas. However, other areas of the body remain exposed. For example, the shoulder regions have typically been left exposed to permit freedom of movement of the arms. Similarly, the side or lateral regions have been left exposed. Unfortunately, this has particularly been true for soldiers riding in vehicles in hostile areas. Thus, operators wearing vests that provide only front and rear protection are currently exposed to serious injury from bullets, fragmentation, and blast waves that impact their side torso region. Notably, the side torso region is a vulnerable region for a bullet that can penetrate the heart and other vital organs.

One of the difficulties in providing a ballistic vest is that for efficiency purposes a limited number of sizes and shapes of vests are typically produced—such as small, medium, large, and extra large. However, the body types of those wearing the vests vary widely. Thus, further adjustment of the settings of the vests is typically required to achieve an appropriate fit for a particular individual. The adjustment is typically accomplished through the use of shoulder straps and a cummerbund portion on the vest. Such adjustment does not significantly affect the lateral positioning of the front and rear armor used in the vest. However, it does affect the positioning of any side armor protection built into a vest as a permanent feature. Thus it causes the armor to be positioned in a less desirable position on many individuals than anticipated by the designer.

Furthermore, with any piece of protective equipment worn by an operator, there is a tradeoff between weight and protection. Ideally, the operator wants to cover the desired vital areas where protection is needed and not have to carry the weight of additional armor covering areas where protection is not needed. This is often a decision made based on the operation that the operator will be performing. For example, an operator who needs to be able to move quickly and stealthily may choose to use little body armor; while, an operator who is standing guard in an exposed position may choose to wear as much body armor as possible. Similarly, an operator riding in a vehicle may desire a significant amount of side protection on the exposed side of the vehicle so as to prevent injury from that side. However, less side protection would be needed on the other side of the operator's body since that side would be less exposed. The operator won't necessarily know which side of the vehicle he will be riding in; thus, flexibility is desirable to be able to adjust the side protection appropriately.

Similarly, an operator may desire side armor protection closer to the front of the body in some situations and closer to the back of the body in other situations. Moreover, the operator may want side armor protection higher or lower on the lateral torso region for a given situation.

Vests also provide the ability to carry additional equipment such as pouches, communication equipment, medical equipment, and water. However, there is a limited amount of surface area for carrying this equipment. The area of the vest at the front and sides usually provides the best point of attachment from the user's perspective, as it allows the user to view and grasp the equipment when needed. Thus, one previous downside to attaching a piece of equipment to the side of the vest was that it used up that area of the vest for attaching other pieces of equipment.

Thus, there is a need for a system that provides side armor protection for a user—preferably for a system that overcomes drawback(s) noted above.

SUMMARY

According to one embodiment of the invention, a modular apparatus for carrying armor is provided comprising an armor carrier having a cavity configured for receiving an armor plate; a first coupling device coupled with the armor carrier and configured for coupling the armor carrier with an article of clothing; wherein the armor carrier is configured as a modular unit so as to permit removal and recoupling of the armor carrier with the article of clothing in multiple positions.

Another embodiment of the invention provides an apparatus for carrying armor that comprises an armor carrier having a cavity configured for receiving an armor plate; a first coupling device coupled with the armor carrier and configured for coupling the armor carrier with an article of clothing; coupling material disposed on the outer surface of the armor carrier so as to provide coupling locations for additional pieces of equipment on the outer surface of the armor carrier when the armor carrier is coupled with the article of clothing.

Still another embodiment of the invention provides a kit of materials for assembly in the field wherein the kit comprises a vest configured to be worn by a user; a first modular side armor device configured to provide ballistic protection and configured to be coupled with the vest so as to provide ballistic protection for the side torso region of the user when the vest is worn by the user.

DESCRIPTION

Figure 1:
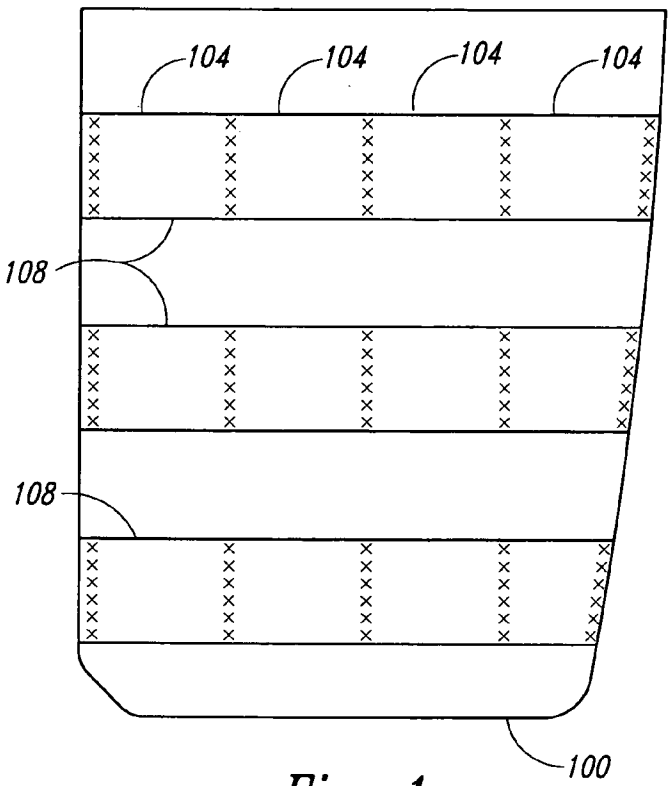
FIG. 1 illustrates a front external view of a side armor protection apparatus, according to one embodiment of the invention.

Referring now to FIG. 1, an embodiment of a side armor protection device can be seen. FIG. 1 illustrates a side armor protection device 100 that is configured for providing ballistic protection for the side torso region of a user when the side armor protection device is worn by the user. This can be accomplished by coupling the side armor protection device with a vest worn by the user, such as a PREDATROR™ vest manufactured by Diamondback Tactical LLLP of Peoria, Ariz.

FIG. 1 shows the external view of a side armor protection device. From this external view, it can be seen that the side armor protection device can be configured with webbing strips 108 that are sewn to the side armor protection device at regular intervals. By sewing the webbing to the nylon material used for this embodiment of the side armor protection device at regular intervals, such as 1.5 inch intervals, loops 104 can be formed. These loops allow straps from additional pieces of equipment to be coupled with the outer surface of the side armor protection device. Thus, the side armor protection device does not take away surface area that an operator might want to use to carry additional pieces of equipment. Rather, additional pieces of equipment can be coupled with the side armor protection device via the webbing strips 108. Thus, the side armor protection device can provide ballistic protection while not taking away available surface area that the operator might want to use to carry equipment.

Figure 2:
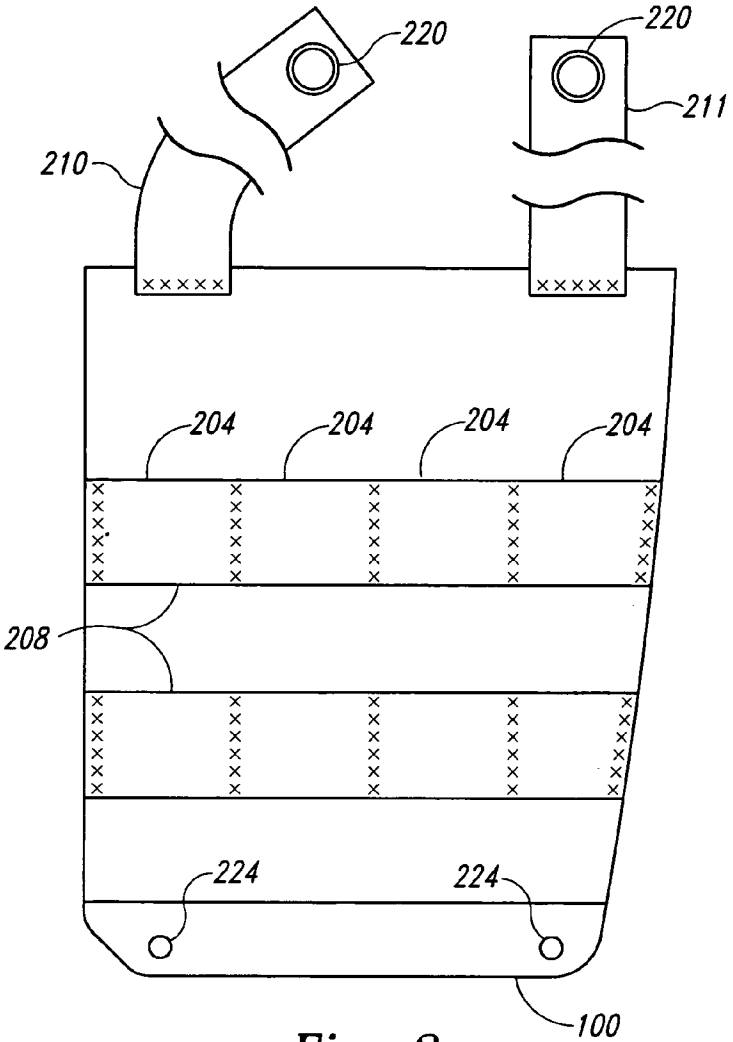
FIG. 2 illustrates a rear external view of a side armor protection device, according to one embodiment of the invention.
Figure 5:
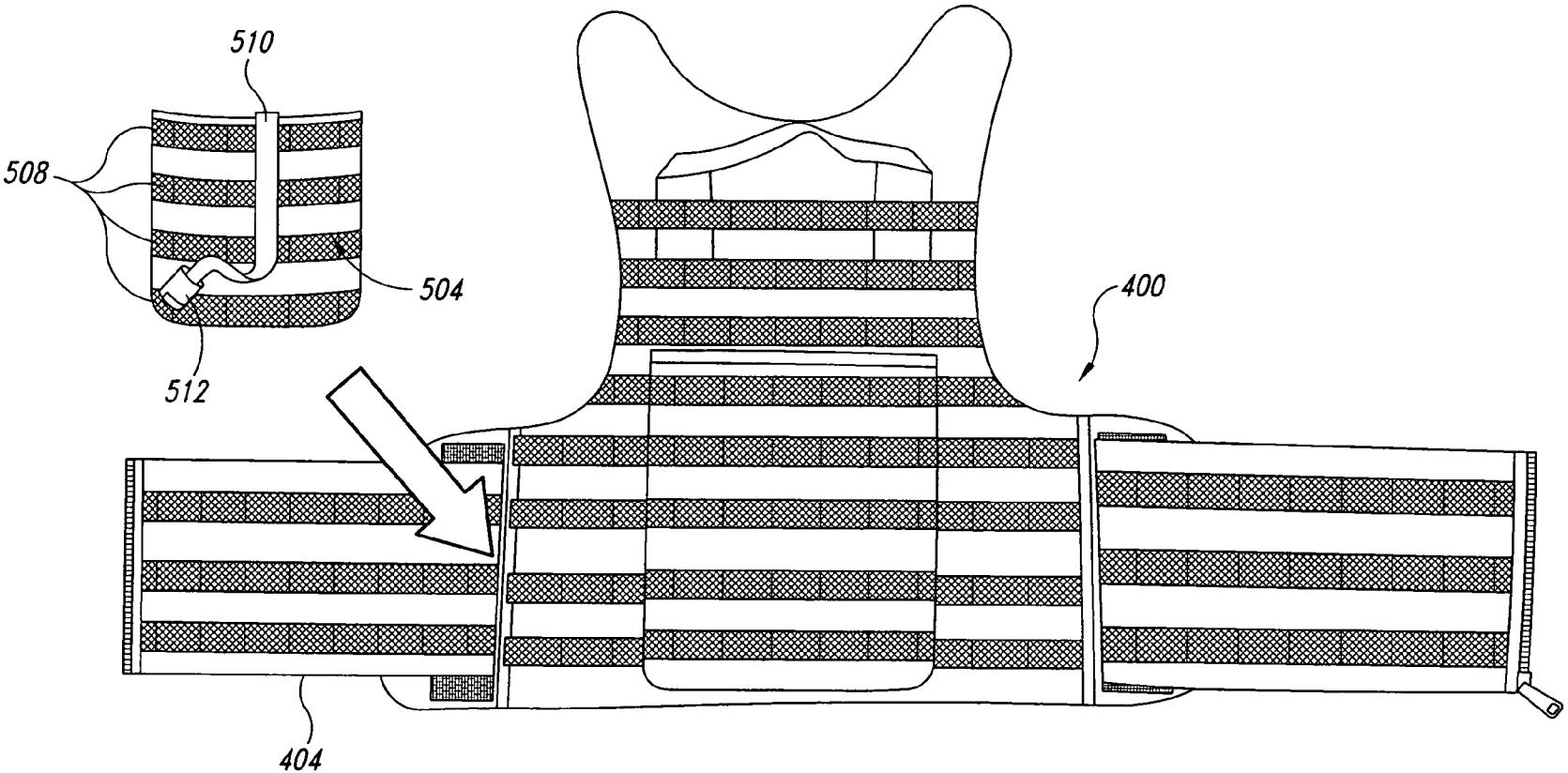
FIG. 5 illustrates a vest and side armor protection device for assembly in the field.
Figure 6:
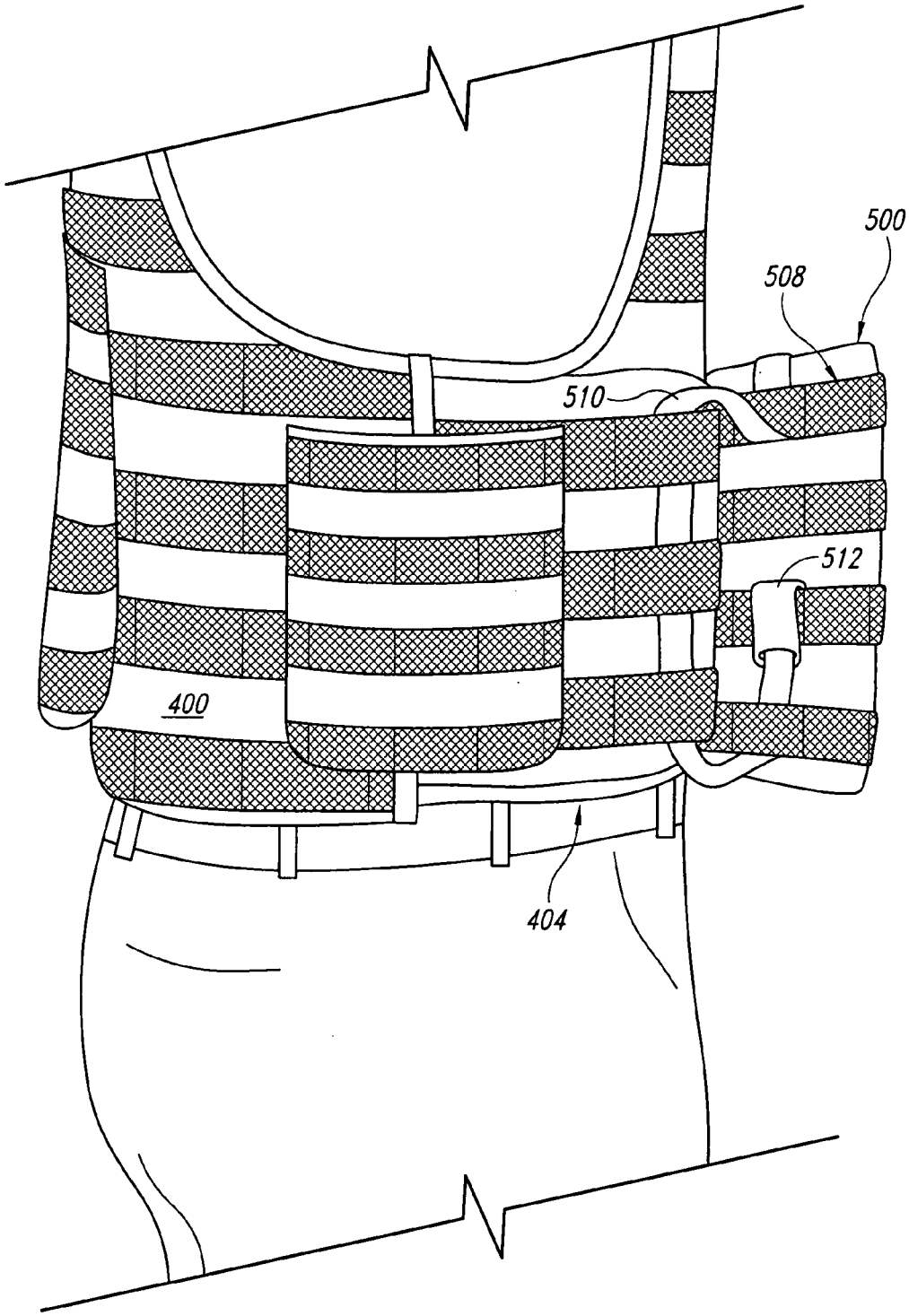
FIG. 6 illustrates the assembled kit of the side armor protection device and vest shown in FIG. 5.

FIG. 2 illustrates a rear view of a side armor protection device. FIG. 2 shows additional webbing strips 208 sewn to the rear external surface of the side armor protection device 100. Thus, loop portions 204 are formed from the sewn down portions of webbing. In addition, FIG. 2 shows that straps 210 and 211 can be sewn to the top portion of the side armor protection device for use in coupling the side armor protection device with a piece of clothing or equipment. Strap 210 is shown in cutaway view having a snap socket portion 220 disposed at the end portion of strap 210. A similar snap socket portion 220 is disposed at the end of strap 211 as well. Straps 210 and 211 can be threaded through the webbing on a vest, for example, so as to couple the side armor protection device 100 with the vest or with some other desired piece of equipment. A snap stud portion 224 can be provided at the bottom portion of the side armor protection device 100 so as to couple with the snap socket portion 220 and thus, couple the side armor protection device with the vest. The use of snaps is merely exemplary and is not necessarily required. Other types of securing devices can be utilized as well for securing the straps. For example, a hook might be utilized as shown in FIGS. 5 and 6.

Webbing portions 208 in FIG. 2 are shown spaced apart on the rear external surface of the side armor protection device so as to allow an interlocking arrangement with the webbing strips on a vest. These webbing strips allow the side armor protection device to be coupled more snugly with the equipment when used in this way.

The use of a strap attachment system provides a high degree of modularity for the side armor protection device. Essentially, the use of a webbing system on a vest and the use of straps on the side armor protection device allows the side armor protection device to be located at a desired position on the torso of an operator according to the operator's choosing. This allows the operator to position the side armor protection device in a location that will provide the greatest amount of ballistic protection as foreseen by the operator. For example, operators anticipating a frontal assault may position the side armor protection devices closer to the front portion of the torso so as to provide ballistic protection closer to the anterior area of the user.

Alternatively, a soldier traveling in a vehicle which is open to attack from the side may prefer to position the side armor protection in the lateral area of the torso, as opposed to closer to the front. This would provide the greatest degree of side protection for that situation. Furthermore, since different vests fit different sized soldiers differently, the modular aspect of the side armor protection device allows the soldier to position the side armor protection at a desired height on the vest, so as to provide the greatest degree of protection for that particular sized soldier. A standardized vest with side protection built into the vest would cause the standardized location of the side armor protection to be positioned at less desirable locations if the soldier's body type did not match the body type for which the vest was designed. The modular aspect of a modular side protection device overcomes such a problem.

Figure 3:
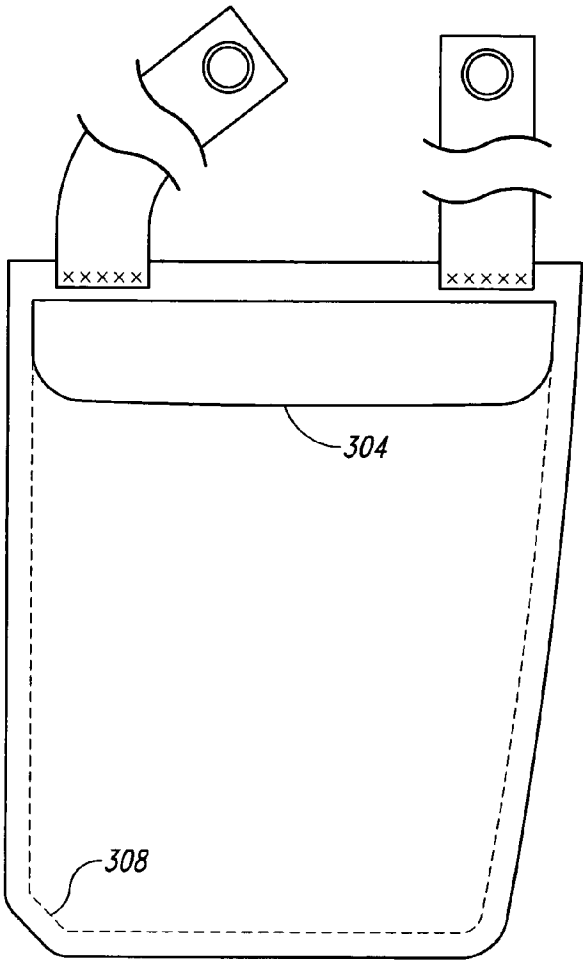
FIG. 3 illustrates a side armor protection device comprising a pocket for removably securing armor, according to one embodiment of the invention.

FIG. 3 illustrates that the side armor protection device can be configured by providing a cavity shown in a dashed line form in FIG. 3 and designated 308. This cavity can be formed by forming an opening between two pieces of nylon that are sewn together or by other means recognized by those of ordinary skill in the art. Furthermore, the cavity can be sewn closed once the armor is disposed within the cavity. Alternatively, a reclosable flap can be utilized, such as flap 304. Thus, FIG. 3 shows that a pocket can be made from the cavity 308 and reclosable flap 304. Use of a pocket allows the user to select the desired armor plate or soft body armor for carrying in the pocket. For example, an operator may select soft body armor for a certain tactical situation and hard body armor for a different tactical situation. Furthermore, in certain areas of the world, an operator may select one type of hard body armor for the weapons utilized in that portion of the world and a different type of hard body armor when operating in a different portion of the world against different weaponry. Thus, the pocket allows the operator to purchase a single armor carrier and swap out the desired armor to be carried within the carrier according to the situation. This cuts down on the cost incurred by the operator. The flap 304 can be secured with a hook and loop closure mechanism or any alternative closure mechanism that would be readily apparent to one of ordinary skill in the art.

Figure 4:
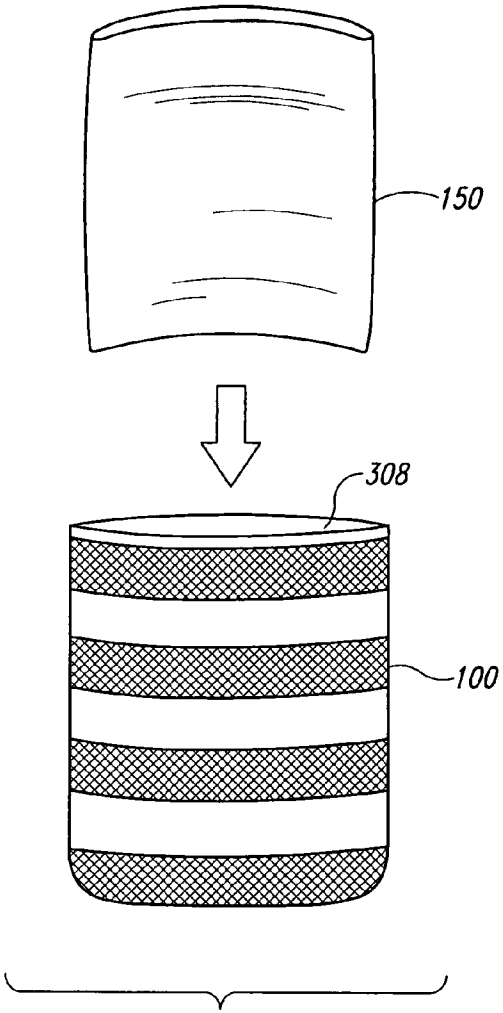
FIG. 4 illustrates the assembly of a side armor protection device, according to one embodiment of the invention.

FIG. 4 illustrates the insertion of armor into the cavity of an armor carrier. Namely, FIG. 4 illustrates that a cavity 308 is established between pieces of materials, such a Cordura™ nylon for armor carrier 100. An armor plate 150 is shown in FIG. 4 as being deposited in the cavity of the armor carrier. The armor plate can have a rating capable of providing ballistic protection to a user. Thus, a plate can be selected to provide, for example, Type III or Type IV level of protection under NIJ 0101.04 protocol. For example, ballistic plate 150 can be configured from steel with a twenty inch radius of curvature so as to provide NIJ type IV protection.

FIGS. 5 and 6 illustrate how a side armor protection device can be disposed on the side of a user's vest. FIG. 5 shows a side armor protection device 500 having webbing strips 508 forming loops 504. A securing strap 510 is shown having a hook 512 at the end region. Furthermore, FIG. 5 shows a vest 400 having webbing strips disposed on its external surface. A cummerbund portion 404 is shown for extending around the side of a user when the vest is worn by the user. FIG. 6 shows the side armor protection device 500 coupled with the cummerbund portion 404 of the vest 400. As can be seen in FIG. 6, the strap 510 extends through the loops on the webbing strips of the cummerbund portion and loops back through a loop on the rear portion of the side armor protection device. The hook 512 is then coupled with a loop sewn on the rear portion of the side armor protection device. Thus, a releasable yet secure coupling can be made between the side armor protection device and the vest. Such a coupling is shown further in U.S. patent application Ser. No. 10/759,916, entitled "Strap Attachment System" and filed on Jan. 16, 2004 which is hereby incorporated by reference in its entirety for all purposes.

Figure 7:
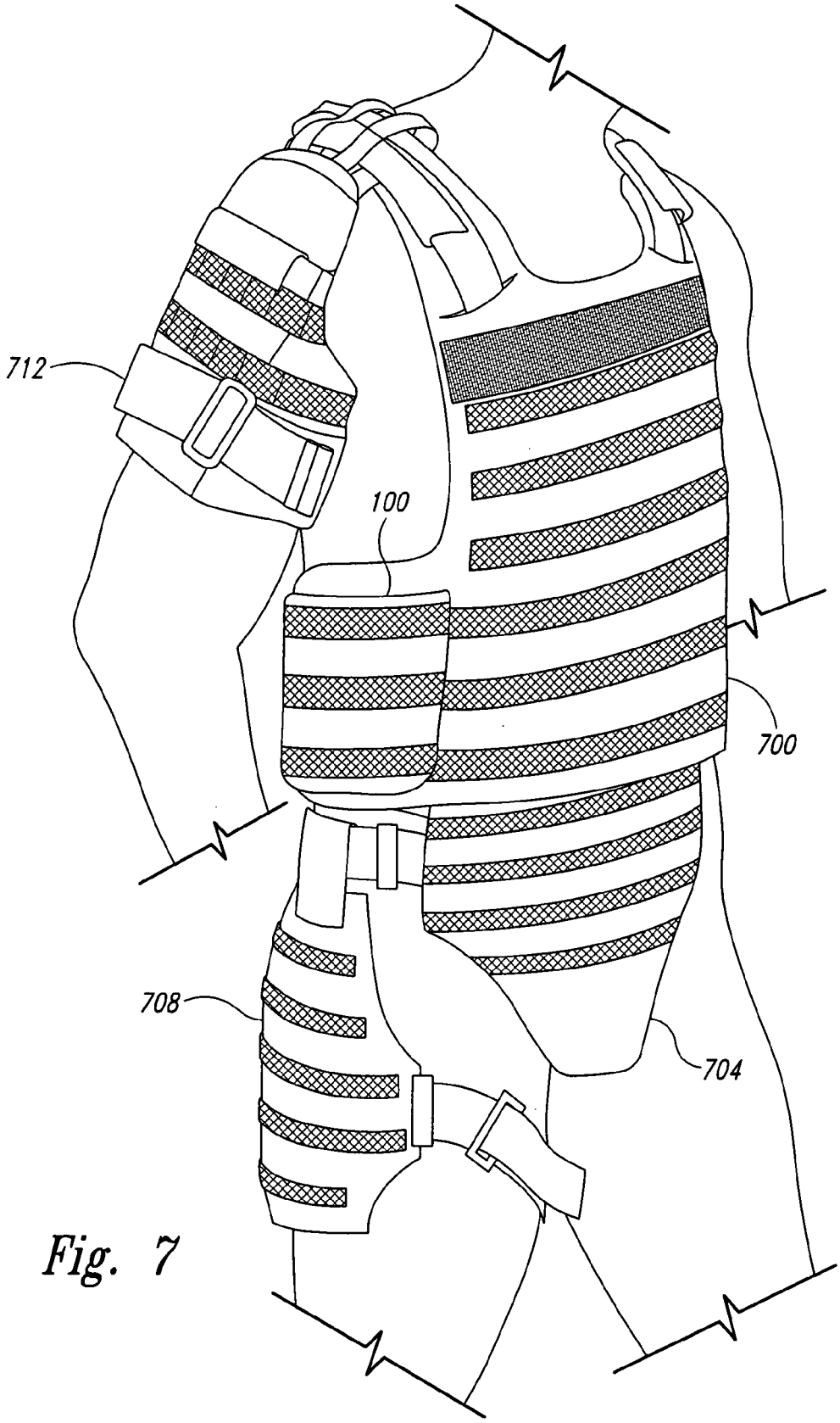
FIG. 7 illustrates a perspective view of a user wearing a kit made up of a vest, side armor protection device, groin protector, outer leg protector, and shoulder protector.

FIG. 7 shows a user wearing a side armor protection device. The user is shown wearing a vest 700. Coupled to the vest is a modular groin protector and femoral artery protector 704. In addition, a modular leg protector 708 is shown protecting the outer region of the user's leg. Similarly, a shoulder protector or biceps protector 712 is shown protecting the upper arm and side of the upper chest from ballistics and fragmentation. The side armor protection device 100 is shown coupled with the webbing of the vest 700. Furthermore, the side armor protection device provides webbing strips for securing additional pieces of equipment to the user. Thus, the pieces of equipment shown in FIG. 7 can be provided in kit form to equip an operator based on the operator's tactical operation. Furthermore, additional pieces of equipment can be coupled with the operator, such as those shown in the 2004-2005 Diamondback Tactical catalog available from Diamondback Tactical LLLP of Peoria, Ariz., the contents of which are hereby incorporated by reference for all purposes. Similarly the following US patent applications show further examples of vests, groin protection devices, shoulder protection devices, leg protection devices, and back protection devices and are hereby incorporated by reference in their entirety and for all purposes: U.S. patent application Ser. No. 10/848,280 entitled "Apparatus and Method for An Adjustable Vest" filed on May 17, 2004; U.S. patent application Ser. No. 10/940,169 entitled "Body Protector" and filed on Sep. 13, 2004; U.S. provisional patent application 60/570,786 entitled "Method and Apparatus for Providing Ballistic Shoulder Protection" and filed on May 12, 2004; U.S. design patent application 29/207,832 entitled "Vest" and filed on Jun. 18, 2004; and U.S. provisional patent application 60/601,334 entitled "Body Armor" and filed on Aug. 13, 2004.

It is also noted that many of the structures, materials, and acts recited herein can be recited as means for performing a function or steps for performing a function. Therefore, it should be understood that such language is entitled to cover all such structures, materials, or acts disclosed within this specification and their equivalents, including the matter incorporated by reference.

It is thought that the apparatuses and methods of the embodiments of the present invention and its attendant advantages will be understood from this specification. While the above is a complete description of specific embodiments of the invention, the above description should not be taken as limiting the scope of the invention as defined by the claims.

What is claimed is:

1. A modular apparatus for holding armor, said apparatus comprising:

an armor carrier comprising a cavity configured for receiving an armor plate; and a first coupling device coupled with said armor carrier and configured for coupling said armor carrier with an article of clothing, said first coupling device including at least one strap;

wherein said armor carrier is configured as a modular unit so as to permit removal and recoupling of said armor carrier with said article of clothing in a plurality of positions;

wherein said at least one strap is configured to be strapped through one or more loops disposed on said article of clothing so as to couple said armor carrier with said article of clothing; and wherein said armor carrier comprises webbing disposed on an outer facing surface of said armor carrier so as to provide coupling loops for attachment of additional pieces of equipment to the outer surface of said armor carrier.

2. The apparatus as described in claim 1 wherein said armor carrier comprises coupling material disposed on the outer surface of said armor carrier so as to provide coupling locations for additional pieces of equipment on the outer surface of said armor carrier.

3. The apparatus as described in claim 1 wherein said armor carrier comprises webbing disposed on the inner facing external surface of said armor carrier so as to facilitate coupling of said armor carrier with said piece of clothing.

4. The apparatus as described in claim 1 and further comprising:

said armor plate disposed in said cavity.

5. The apparatus as described in claim 4 wherein said armor plate provides Type III level of protection under NIJ 0101.04 protocol.

6. The apparatus as described in claim 4 wherein said armor plate provides Type IV level of protection under NIJ 0101.04 protocol.

7. The apparatus as described in claim 4 wherein said armor plate comprises a plate made substantially of steel.

8. The apparatus as described in claim 4 wherein said armor plate comprises a plate made substantially of a steel alloy.

9. The apparatus as described in claim 4 wherein said armor plate is substantially made of ceramic material.

10. The apparatus as described in claim 1 wherein said cavity is formed by a recloseable pocket so as to allow said armor plate to be removeable.

11. The apparatus as described in claim 1 wherein said armor plate is sealed in said cavity so as not to be removeable during use of said armor carrier.

12. The apparatus as described in claim 1 and further comprising:

a second coupling device.

13. The apparatus as described in claim 12 wherein said second coupling device comprises a strap configured for disposition through a loop of webbing disposed on said article of clothing.

14. An apparatus for holding armor, said apparatus comprising:

an armor carrier comprising a cavity configured for receiving an armor plate;

a first coupling device coupled with said armor carrier and configured for coupling said armor carrier with an article of clothing; and coupling material disposed on the outer surface of said armor carrier so as to provide coupling locations for additional pieces of equipment on the outer surface of said armor carrier when said armor carrier is coupled with said article of clothing, said coupling material including webbing disposed on the outer surface of said armor carrier.

15. A kit of materials for assembly in the field, said kit comprising:

a vest configured to be worn by a user; and a first modular side armor device configured to provide ballistic protection and configured to be coupled with said vest so as to provide ballistic protection for the side torso region of said user when said vest is worn by said user;

wherein the first modular side armor device includes:

an armor carrier comprising a cavity configured for receiving an armor plate; and a first coupling device coupled with said armor carrier and configured for coupling said armor carrier with an article of clothing;

wherein said armor carrier comprises webbing disposed on an outer facing surface of said armor carrier so as to provide coupling loops for attachment of additional pieces of equipment to the outer surface of said armor carrier.

16. The kit as described in claim 15 wherein said first modular side armor device is one of a plurality of modular side armor devices in said kit.

17. The kit as described in claim 15 and further comprising a modular shoulder protector configured to be coupled with said vest.

18. The kit as described in claim 15 and further comprising a modular groin protector configured to be coupled with said vest.

19. The kit as described in claim 15 and further comprising a lower back protector configured to be coupled with said vest.

20. The kit as described in claim 15 and further comprising an outer leg protector configured to be coupled with said vest.

* * * * *